United States Patent [19]

Kobe et al.

[11] Patent Number: 5,050,624

[45] Date of Patent: Sep. 24, 1991

[54] DISPOSABLE EYE MAKEUP SHIELD

[76] Inventors: Vivian Kobe; Brian Kobe, both of 6933 SW. 110th Ave., Miami, Fla. 33173

[21] Appl. No.: 636,698

[22] Filed: Jan. 2, 1991

[51] Int. Cl.[5] ..... A45D 40/30

[52] U.S. Cl. ..... 132/319; 132/216

[58] Field of Search ..... 132/319, 216, 218, 320

[56] References Cited

U.S. PATENT DOCUMENTS

| | | | |
|---|---|---|---|
| D. 119,329 | 3/1940 | Leyne | 132/216 |
| 1,850,540 | 3/1932 | Erickson | 132/216 |
| 1,873,928 | 8/1932 | Bohner | 132/216 |
| 3,789,856 | 2/1974 | Bomba | 132/319 |
| 4,033,364 | 7/1977 | Inzana et al. | 132/216 |

*Primary Examiner*—Gene Mancene
*Assistant Examiner*—Adriene B. Lepiane
*Attorney, Agent, or Firm*—Malloy, Downey & Malloy

[57] ABSTRACT

A disposable eye makeup shield for use during the application of eye makeup being specifically structured to provide a barrier or protective shield over the lower eyelid and areas of the user's face below the eyes, thereby preventing excess makeup from falling thereon or onto the user's clothing during makeup application. The makeup shield includes a flexible, yet rigid interior body forming a frame structure and having an outer convex, arcuate side and an inner concave side, the interior body defining an overall general configuration of the eye makeup shield. The interior body further includes a lower portion and an upper portion having outwardly extending wings and a top edge being specifically curved and configured to conform with the contour of the user's lower eyelid. An outer layer of substantially porous, absorbent material is adhered to the convex outer side of the interior body and an inner, congruent layer of substantially soft material is adhered to the concave inner side of the interior body, the outer porous material being adapted to catch and substantially absorb makeup falling thereon during application. The lower portion of the interior body includes a grasping area to facilitate holding and positioning of the makeup shield in a preferred position against the lower eyelid.

13 Claims, 2 Drawing Sheets

DISPOSABLE EYE MAKEUP SHIELD

BACKGROUND OF THE INVENTION

1. Field of the Invention

The present invention relates to a disposable eye makeup shield for use during application of eye makeup to protect the lower eyelid, cheekbone area and other facial areas from excess makeup falling thereon during application.

2. Description of the Relates Art

The task of applying makeup to areas surrounding the eye including eyelashes, eyelids and eyebrows is certainly a tedious one and requires the use of various brushes, pencils and other applicators depending upon the application surface. To properly apply the various types of makeup including mascara, eyeliners, eye shadows and the like, a great deal of patience and a steady hand is required so that the makeup is not smudged or smeared in with previously applied cosmetics. However, even a steady hand does not prevent makeup from dripping or falling off the applicator and onto the user's cheekbone area and lower eyelid, as well as onto the user's clothing.

There are numerous devices in the related art which are specifically designed to assist in the application of eye makeup. Included i related art are the devices found in U.S. Pat. No. 3,789,856 to Bomba; U.S. Pat. No. 1,873,928 to Bohenr; U.S. Pat. No. 1,907,476 to Ballard et.al.; and U.S. Pat. No. 1,974,825 to Lovie. All of the devices in the above mentioned related art are designed to provide a guide or edge to facilitate the application or removal of eyelash makeup. Generally, these devices are made of plastic or other nonabsorbent materials and are specifically constructed to provide a guide or barrier between the lower eyelash and the lower eyelid during the application of mascara, thereby preventing the mascara brush from touching the lower eyelid area. None of these devices in the related art are specifically adapted to absorb makeup which falls off the applicator or applied area during eye makeup application. Thus, makeup such as mascara which falls on these devices made of plastic or other like materials would naturally run down their outer surface and onto the user's fingers, cheekbone area or even clothing.

Accordingly, there is a need in the present makeup art for a disposable eye makeup shield adapted to be placed against the lower eyelid during application of eye makeup and being specifically structured to absorb excess makeup which may fall thereon during application, thereby effectively protecting the lower eyelid and other facial areas as well as the user's clothing. In this manner, not only does the user stay clean, but the entire surrounding area including the furniture, carpet and counter surface remain clean and sanitary.

SUMMARY OF THE INVENTION

The present invention is directed towards a disposable eye makeup shield for use during application of eye makeup including but not limited to mascara, eyeliners, eye shadows, moisturizers, creams, highlighters, etc.

The eye makeup shield of the present invention includes an interior frame structure formed of a flexible, yet rigid material such as a thin plastic. The interior frame structure includes a lower portion and an upper portion having outwardly extending opposite wings and a top edge. The interior frame structure and top edge are specifically formed and configured so as to conform with the outer curvature of the lower eyelid such that the top edge can be placed in confronting engagement along the entire length of the lower eyelid during the application of eye makeup.

An outer layer of porous, substantially absorbent material is adhered to an outer convex side of the interior frame structure in substantially covering relation thereto, forming a shield structure adapted to catch and substantially absorb makeup falling thereon during application. Further, an inner congruently configured layer is adhered to an inner convex side of the interior frame structure so as to mate with the outer layer along correspondingly positioned peripheral edges.

The lower portion of the interior frame structure may include a grasping portion to facilitate grasping between the user's fingers so that the eye makeup shield can be held and positioned in a preferred orientation during makeup application. Additionally, a removable, elongate handle may be provided which is attachable to a bottom edge of the grasping area of the interior frame structure so as to provide an extended handle. In this manner, the grasping hand is moved away from the eye area so as not to interfere with the applicating hand when applying makeup around the eye area. While the grasping portion is a highly desirous feature, it can be eliminated from the lower portion. The elongate handle could then simply be attached to the lower edge of the shield so that the user is better able to manipulate the shield against the lower eyelid.

While the main purpose of the present invention is to provide a barrier or a shield of protection to the lower eyelid and cheekbone area to protect from excess eye makeup from falling thereon during application to the upper eyelid, the device is also useful as a shield for the lower eyelid area during application of mascara thereto. After applying mascara to the lower eyelashes, the eye makeup shield can be raised slightly up and out so as to blot away excess mascara from the underside of the lower lashes. The porous outer layer is adapted to substantially absorb the excess mascara on the underside of the lashes preventing mascara from smudging or streaking on the lower eyelid area when blinking or excessive movement occurs before the mascara has had sufficient time to dry.

Still further, the eye makeup shield of the present invention can also be used as a guide along the lower eyelid area during the application of eye shadow to the lower eyelid or during the application of eye lining makeup using pencils, liquid eyeliners or powder applied with a brush.

After use, the shield can be easily disposed of, requiring no additional clean up. Thus, a clean sanitary makeup area is always maintained after each use.

Accordingly, the features and advantages of the eye makeup shield, as described above, allow the user to create much more dramatic eyes using a variety of eye makeup products without the fear that previously applied cosmetics will be smudged, disturbed or otherwise, ruined.

The invention accordingly comprises the features of construction, combination of elements and arrangement of parts which will be exemplified in the construction hereinafter set forth and the scope of the invention will be indicated in the claims.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
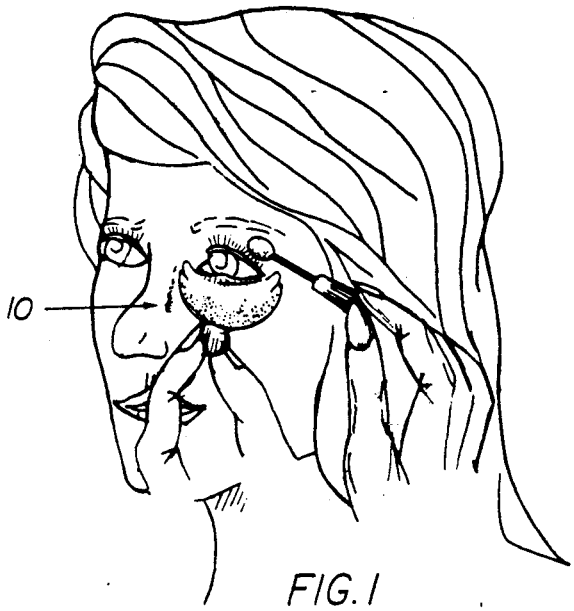
FIG. 1 is a perspective view illustrating the use of the eye makeup shield of the present invention during the application of makeup.
Figure 2:
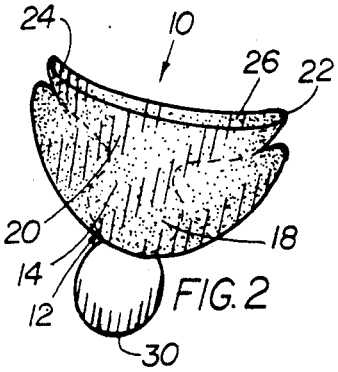
FIG. 2 is a front plan of an outer convex side of the eye makeup shield of the present invention.
Figure 3:
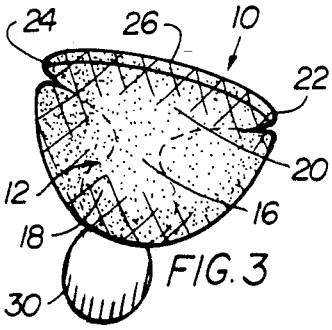
FIG. 3 is a rear plan view of an inner concave side of the eye makeup shield of the present invention.
Figure 4:
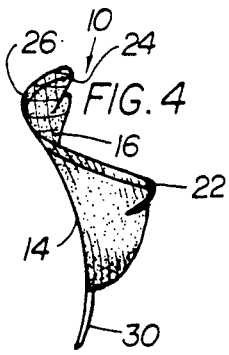
FIG. 4 is a perspective view of the eye makeup shield in FIGS. 1 through 3.

As shown in FIGS. 1 through 7, the present invention is directed towards a disposable eye makeup shield, generally indicated as 10, for use during the application of eye makeup to prevent excess makeup from falling onto the lower eyelid and other facial areas as well as the user's clothing.

The eye makeup shield 10 in the preferred embodiment of the present invention includes an interior flexible, yet rigid body 12, 12' represented by the broken lines in FIGS. 2, 3, 5 and 8. The interior body 12 provides a frame structure which substantially defines the overall configuration of the eye makeup shield and includes an outer convex, substantially arcuate side 14 and an inner convex side 16. The interior body 12 further includes a lower portion 18 and an upper portion 20. The upper portion 20 includes outwardly extending opposite wings 22 and 24 with a top edge 26 extending therebetween. The top edge 26 is specifically structured and configured so as to conform with the outer curved configuration of the user's lower eyelid with the opposite wings 22 and 24 being somewhat flexible so as to adapt to various eyelid configurations of different users.

Extending down from the lower portion 18 of the interior body 12, the preferred embodiment further includes a grasping tab 30 which is disposed and configured to facilitate grasping by the user, preferably between the index finger and the thumb, wherein the eye makeup shield can be held and positioned in a preferred orientation against the lower eyelid during application of makeup.

Figure 6:
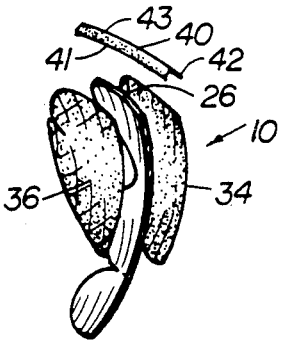
FIG. 6 is an exploded view shown in perspective illustrating the structural features of the present invention.

Referring to FIG. 6, the construction of the eye makeup shield is best illustrated and includes an outer layer of porous, substantially absorbent material 34 adhered to the outer convex side of the interior body 12 in substantially covering relation thereto and preferably extending outwardly on both sides of the lower portion 18 so as to form a protective shield which will effectively cover and shield a substantial area below and around the lower eyelid. Thus, with the eye makeup shield held in a preferred position with the top edge 26 against the lower eyelid and the grasping tab 30 held outwardly away from the cheekbone, any excess makeup falling during application will land on the porous outer layer of material 34, being substantially absorbed thereby and preventing the makeup from landing on the lower eyelid or other facial areas.

An inner, congruently configured layer of material 36 is adhered to the inner concave side 16 of the interior body 12 so as to substantially cover the inner concave surface with an outer peripheral edge mating with a correspondingly positioned outer peripheral edge of the outer layer of porous material 34 providing a one piece uniform appearance. The inner layer 36 is preferably formed of a soft, substantially absorbent material such as cotton fiber providing a comfortable surface adapted for partial engagement with the facial area just below the lower eyelid.

The preferred embodiment of the present invention further includes a comfort strip 40 fitted along the top edge 26 to provide for comfortable engagement against the lower eyelid when the eye makeup shield of the present invention is held in a preferred position during makeup application. The comfort strip 40 is generally formed of a soft absorbent material having an increased thickness along the top edge 26 to prevent the lower eyelid from being cut or irritated by the relatively thin top edge 26 of the interior body 12. As seen in FIG. 6, the comfort strip 40 preferably includes two sides 41 and 42 extending downwardly from a center seam 43. The comfort strip is adapted to be fitted to the top edge 26 with the center seam 43 overlying the top edge 26 and the downwardly extending flaps 41 and 42 overlapping on opposite sides of the eye makeup shield.

Figure 5:
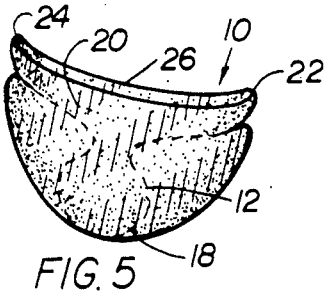
FIG. 5 is a front plan view of an alternative embodiment of an outer convex side of the present invention.
Figure 7:
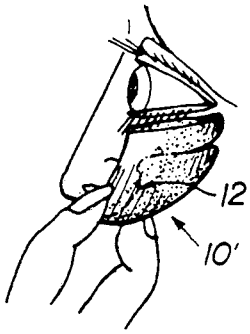
FIG. 7 is a perspective view illustrating the eye makeup shield of FIG. 5 being held in a preferred position against the lower eyelid during makeup application.

As seen in FIGS. 5 and 7, an alternative embodiment of the present invention, generally indicated as 10', eliminates the grasping tab 30 so that the eye makeup shield can be simply grasped at the lower portion 18 of the interior body. In this manner, when the top edge 26 is positioned against the lower eyelid as seen in FIG. 7, the lower portion 18 is held slightly away from the upper cheekbone area thereby positioning the outer porous layer or shield structure in a preferred orientation so as to effectively catch excess makeup falling from the eye area during application.

Figure 8:
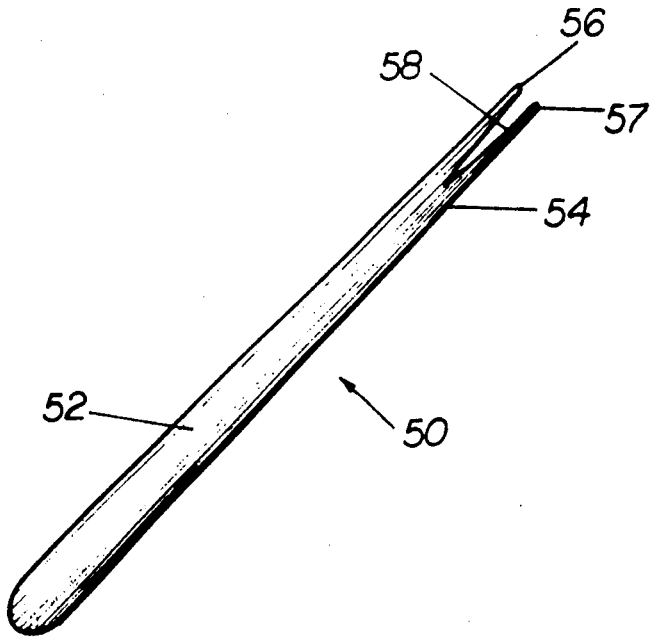
FIG. 8 is a perspective view of a handle attachment for use with the eye makeup shield of the present invention.
Figure 9:
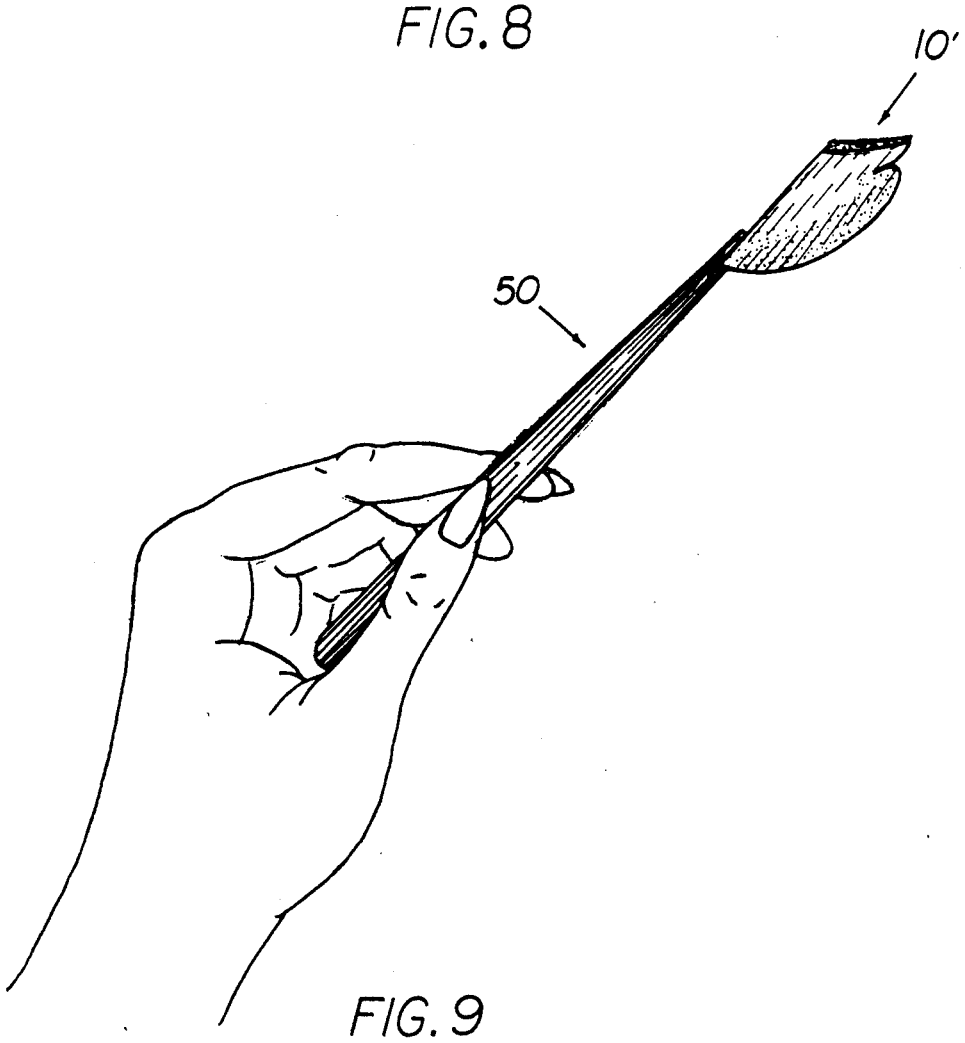
FIG. 9 is a perspective view illustrating the handle attachment of FIG. 8 in use with the eye makeup shield of the present invention during the application of eye makeup.

An additional feature of the present invention is illustrated in FIGS. 8 and 9 and comprises an elongate handle 50 which can be attached to a bottom edge of the lower portion 18 of the interior body 12 as illustrated in FIG. 9. Additionally, the elongate handle 50 can be attached to the grasping tab 30 of the preferred embodiment. In either case, with the elongate handle attached, the makeup shield can be held in the preferred position against the lower eyelid with the holding hand removed from the eye area so as to not interfere with the applicating hand when applying the makeup. As seen in FIG. 8, the elongate handle 50 generally includes a grasping area 52 which can be easily grasped in the user's hand in any desired manner. Additionally, the elongate handle 50 includes an attachment end 54 including two tapered prongs 56 and 57 extending on opposite sides of a receiving slot 58 structured to receive the bottom edge of the eye makeup shield 10 therein, as shown in FIG. 9. The tapered construction of the prongs 56 and 57 results in the receiving slot 58 having a decreasingly tapered construction so that the bottom edge of the makeup shield is effectively wedged and captivated therein. Accordingly, the makeup shield is maintained in connection with the elongate handle 50 for use.

While the instant invention has been shown and described in what is considered to be a practical and preferred embodiment, it is recognized that departures may be made within the spirit and scope of this invention which is therefore not to be limited except as set forth in the claims hereinafter and within the Doctrine of Equivalence.

Now that the invention has been described, What is claimed is:

1. A disposable eye makeup shield for use during the application of makeup to areas surrounding the eye to protect a lower eyelid and surrounding facial area from makeup falling thereon as well as to maintain a surrounding makeup application area in a clean, sanitary condition, the eye makeup shield comprising:

a substantially rigid, yet flexible interior body having a curved construction and including an outer convex side and an inner concave side, said interior body being structured and disposed so as to form a frame structure defining an overall general configuration of the makeup shield, said interior body further including a lower portion and an upper portion, said upper portion including outwardly extending, oppositely disposed wings with a top edge extending therealong and connecting therebetween, said top edge being structured and configured so as to conform with the outer configuration of a user's lower eyelid, an outer layer of porous, substantially absorbent material adhered to said outer convex side in substantially covering relation thereto, said outer layer being adapted to catch and absorb excess makeup falling thereon during application by the user, and an inner layer of soft, substantially absorbent material adhered to said inner concave side of said interior body in substantially covering relation thereto.

2. The eye makeup shield as in claim 1 wherein said interior body is formed of a substantially thin, rigid plastic material being adapted to at least partially flex in response to a force exerted thereon.

3. The eye makeup shield as in claim 2 wherein said interior body is structured and disposed to form a structural inner support frame providing strength and rigidity and defining the overall configuration of the makeup shield.

4. The eye makeup shield as in claim 3 wherein said top edge is formed and configured to be placed in engaging relation along the user's lower eyelid with a remainder of said upper portion and said lower portion extending outwardly away from the user's face so as to position and dispose said outer layer of porous material in catching relation to the excess makeup falling during application.

5. The eye makeup shield as in claim 4 wherein said outer layer and said inner layer extend outwardly on opposite sides of said lower portion of said interior body in overlapping, congruent relation adhering to one another and terminating along corresponding positioned peripheral edges so as to define a shield below said wings.

6. The eye makeup shield as in claim 5 wherein said top edge includes an increased thickness of said porous material forming a cushion to provide for comfortable engagement with the lower eyelid.

7. The eye makeup shield as in claim 5 wherein said top edge includes a cushioning material fitted therealong to provide for comfortable engagement of said top edge with the lower eyelid.

8. The eye makeup shield as in claim 7 further comprising a removable, elongate handle adapted to be attached to a bottom edge of said lower portion forming an extension thereof and providing a more accessible means to hold the makeup shield in a preferred position.

9. The eye makeup shield as in claim 8 wherein said elongate handle includes attachment means on one end including a tapered slot formed in said one end and being structured and disposed to receive said bottom edge of said lower portion of said makeup shield in snug-fitting, retaining relation therein.

10. The eye makeup shield as in claim 3 wherein said top edge extending between said wings is structured and configured so as to define a guide to facilitate application of eye lining makeup to the user's lower eyelid.

11. The eye makeup shield as in claim 1 wherein said interior body includes a grasping portion extending from a bottom of said lower portion being formed and configured to facilitate grasping between the user's fingers so as to enable the makeup shield to be held in a preferred position during the application of the makeup.

12. The eye makeup shield as in claim 11 further comprising a removable, elongate handle adapted to be attached to said grasping portion forming an extension thereof and providing a more accessible means to hold the makeup shield in the preferred position.

13. The eye makeup shield as in claim 12 wherein said elongate handle includes attachment means on one end including a tapered slot formed in said one end and being structured and disposed to receive said grasping portion of said makeup shield in snug-fitting retaining relation therein.

* * * * *